US010420449B2

(12) United States Patent
Park

(10) Patent No.: US 10,420,449 B2
(45) Date of Patent: Sep. 24, 2019

(54) HANDHELD CLEANING APPARATUS

(71) Applicant: Steven Park, Garden Grove, CA (US)

(72) Inventor: Steven Park, Garden Grove, CA (US)

( * ) Notice: Subject to any disclaimer, the term of this patent is extended or adjusted under 35 U.S.C. 154(b) by 0 days.

(21) Appl. No.: 15/603,323

(22) Filed: May 23, 2017

(65) Prior Publication Data

US 2018/0338664 A1 Nov. 29, 2018

(51) Int. Cl.
*A47L 13/16* (2006.01)
*B24D 15/04* (2006.01)
*A47L 13/46* (2006.01)

(52) U.S. Cl.
CPC ..... *A47L 13/16* (2013.01); *A47L 13/46* (2013.01); *B24D 15/04* (2013.01)

(58) Field of Classification Search
CPC ..... A47L 13/00; A47L 13/04; A47L 13/06; A47L 13/07; A47L 13/10; A47L 13/16; A47L 13/17; A47L 13/20; A47L 13/257; A47L 13/28; A47L 13/34; A47L 17/08; A47K 7/02; A47K 7/028; A47K 7/03; B08B 1/00; B08B 1/001; B08B 1/005; B08B 1/006; B43L 21/00; B43L 21/02; B43L 21/04; B24D 15/00; B24D 15/02; B24D 15/023; B24D 15/04
USPC ..... 15/208, 209.1, 221, 223, 224, 229.11, 15/229.13, 244.1, 244.3, 244.4, 118; 401/196, 201, 265; 451/523–525, 557, 451/558; D32/40.52
See application file for complete search history.

(56) References Cited

U.S. PATENT DOCUMENTS 409,652 A * 8/1889 Steel ..... 451/557
1,912,224 A * 5/1933 Schimel ..... A47K 7/03 15/244.4
2,030,911 A * 2/1936 Borden ..... A47L 1/08 15/244.1
2,120,483 A * 6/1938 Burger ..... B24D 15/02 451/557

(Continued)

FOREIGN PATENT DOCUMENTS

EP 458655 * 11/1991
GB 491188 * 8/1938

(Continued)

*Primary Examiner* — Mark Spisich
(74) *Attorney, Agent, or Firm* — TJSL Patent Clinic

(57) ABSTRACT

The handheld cleaning apparatus provides a handheld cleaning apparatus comprising a removable handle, abrasive particles, angled edges, open channels, and a flexible yet durable surface for scouring. The invention creates an abrasive, or "sanding," cleaning apparatus that is better suited for cleaning dirty surfaces than a traditional cleaning sponge. The handheld cleaning apparatus retains the abrasive outer shell of a sanding sponge but is much more flexible and water permeable than current sanding sponges. To this end, the handheld cleaning apparatus comprises open channels, or "blow holes," that promote water flow through the sponge and give the sponge flexibility. The size and the number of the channels vary by the material or density of the sponge. The handheld cleaning apparatus, additionally, contains a handle that is removably attached, which enables the consumer the ability to connect one or more cleaning apparatuses together to form the desired shape and form of the cleaning apparatus.

6 Claims, 6 Drawing Sheets

(56) References Cited

U.S. PATENT DOCUMENTS 2,620,502 A * 12/1952 Russak ..... A47K 5/04 15/244.4
2,866,991 A * 1/1959 Chao ..... A47L 13/14 15/119.2
3,012,265 A * 12/1961 Courtenay ..... A47L 13/257 15/244.1
3,021,649 A * 2/1962 Robbins ..... B24D 15/04 15/118
3,274,635 A * 9/1966 Myers ..... A47L 13/14 15/144.1
3,317,944 A * 5/1967 Napier ..... A46B 11/001 15/223
3,444,579 A * 5/1969 Thomford ..... B43L 21/00 15/118
3,570,038 A * 3/1971 Jones ..... A47L 17/00 15/244.1
3,787,919 A * 1/1974 Siemund ..... A47L 13/25 15/224
4,077,083 A * 3/1978 Siemund ..... A47L 13/257 15/244.1
4,457,643 A * 7/1984 Caniglia ..... A47K 7/03 401/200
5,606,760 A * 3/1997 De Guzman ..... A47L 13/144 15/119.2
6,227,959 B1 5/2001 Beaudry
6,574,825 B1 * 6/2003 Boldy ..... A47L 13/38 15/224
7,011,573 B2 3/2006 McArthur et al.
7,234,189 B2 6/2007 Chen
7,641,538 B2 1/2010 Goers
8,505,150 B2 8/2013 Armaly, Jr.
2004/0229556 A1 * 11/2004 Haider ..... A61B 17/54 451/523
2008/0081546 A1 4/2008 Takinami et al.
2008/0104790 A1 * 5/2008 Tran ..... A47L 13/257 15/244.4
2008/0166178 A1 * 7/2008 Alarcon Grajeda ..... A47K 7/03 401/201
2008/0207099 A1 8/2008 Brown
2010/0229320 A1 * 9/2010 Lee ..... A47L 13/16 15/244.4
2014/0259502 A1 * 9/2014 Vitucci-Schneider ..... A47L 13/16 15/244.4

FOREIGN PATENT DOCUMENTS

GB 2448133 * 8/2008
JP 10-234910 * 9/1998
JP 11-76135 * 3/1999
JP 11-78383 * 3/1999
JP 2000-126070 * 5/2000
JP 2001-212054 * 8/2001
JP 2006-311992 * 11/2006
JP 2006-321456 * 11/2006
JP 2010-148529 * 7/2010
JP 2014-91234 * 5/2014
JP 2015-53969 * 3/2015

* cited by examiner

HANDHELD CLEANING APPARATUS

FIELD OF THE INVENTION

The handheld cleaning apparatus relates to tools for sanding a surface and, more specifically, to a handheld cleaning apparatus comprising abrasive particles, angled edges, open channels, and a flexible yet durable surface for scouring.

BACKGROUND

There are many varieties of cleaning aids, with sponges being the most popular. Sponges are cleaning tools consisting of soft, porous material. Usually used for cleaning impervious surfaces, sponges are especially good at absorbing water and water-based solutions. There are many varieties of sponges including those comprising abrasive particles, artificial fibers, animal fibers, angled edges, and polyurethane foam.

Today, there are many forms of cleaning tools on the market, however, the market lacks cleaning tools that are able to reach tough, resilient places. The most effective cleaning is typically done with handheld tools, as the user typically holds the article in his or her hand, moving the article back and forth, applying pressure as needed.

As cleaning aids continue to develop, there is a need for a handheld cleaning apparatus that provides ergonomic accommodations, a cleaning aid that comprises the abrasive particles for sanding, yet still provides a flexible yet durable surface for scouring. There is a need for an abrasive, or "sanding," cleaning apparatus, which is better suited for cleaning dirty surfaces than a traditional cleaning sponge.

More specifically, a handheld cleaning apparatus is needed on the market that retains the abrasive outer shell of a sanding sponge but is much more flexible and water permeable than current sanding sponges, as difficulties arise when the article is not designed to provide necessary and sufficient cleaning for the user to accomplish the task at hand.

Furthermore, there is a need for a sponge that enables a consumer the ability to connect one or more handheld cleaning apparatuses together to form the desired shape and form needed, yet having the added diamond-angled tips to allow flexibility while reducing the stress applied to clean hard to reach areas.

SUMMARY

A handheld cleaning apparatus comprises a removable handle, abrasive particles, angled edges, channels/openings, and a flexible yet durable surface for scouring. The cleaning apparatus creates an abrasive, or "sanding," sponge that is better suited for cleaning dirty surfaces than is a traditional cleaning sponge.

Additionally, the cleaning apparatus retains the abrasive outer shell of a sanding sponge but is much more flexible and water permeable than current sanding sponges. To this end, the sponge comprises channels, or "blow holes," that promote water flow through the sponge and give the sponge flexibility. The size and the number of the channels vary by the material or density of the sponge.

Furthermore, the cleaning apparatus is configured to receive a removable handle that enables the consumer the ability to connect one or more cleaning apparatuses together to form the desired shape and form of the sponge.

The figures and the detailed description which follow more particularly exemplify these and other embodiments of the invention.

BRIEF DESCRIPTION OF THE FIGURES

Embodiments of the present invention will now be described, by way of example only, with reference to the accompanying figures.

DETAILED DESCRIPTION OF THE INVENTION

Figure 1:
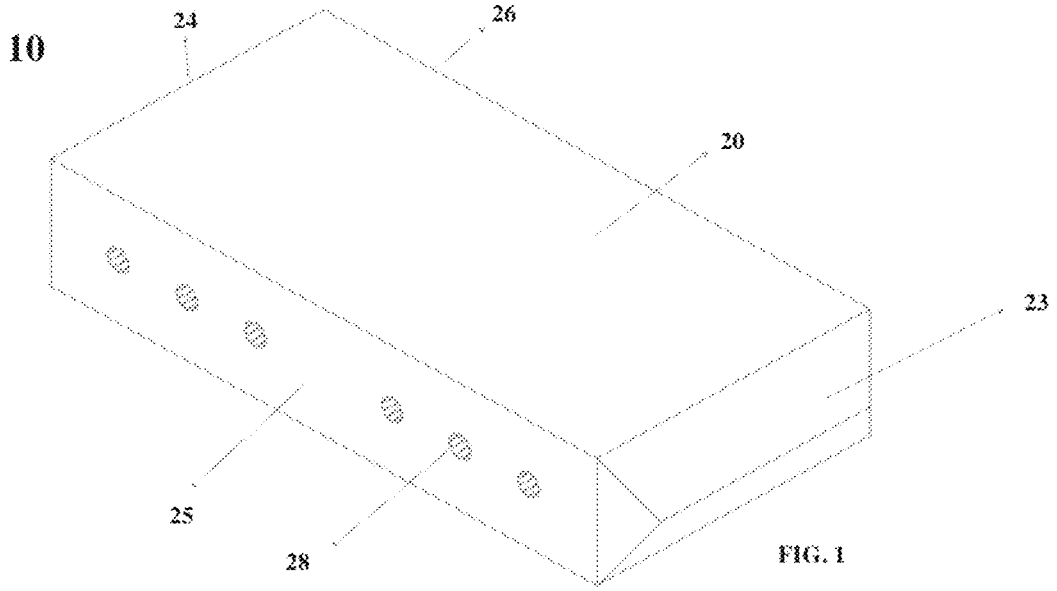
FIG. 1 illustrates an exemplary embodiment of the handheld cleaning apparatus showing longitudinal open channels in accordance with the principles of the present invention.

The following detailed description is merely exemplary in nature and is not intended to limit the disclosure or the application and uses of the disclosure. As used herein, the word "exemplary" means "serving as an example, instance, or illustration." Thus, any embodiment described herein as "exemplary" is not necessarily to be construed as preferred or advantageous over other embodiments. Furthermore, there is no intention to be bound by any expressed or implied theory presented in the preceding technical field, background, brief summary, or the following detailed description.

In this description, reference is made to the drawings, wherein like parts are designated with like reference numerals throughout. As used in the description herein and throughout, the meaning of "a," "an," and "said" includes plural reference unless the context clearly dictates otherwise. Also, as used in the description herein, the meaning of "in" includes "into" and "on" unless the context clearly dictates otherwise.

The handheld cleaning apparatus 10 (See FIG. 1) is designed to assist the user to clean hard to reach areas, promoting flexibility and scouring throughout the process.

The handheld cleaning apparatus 10 retains the abrasive outer shell and is water permeable comprising channels, or "blow holes," that promote water flow through the sponge and give the sponge flexibility. The water flow through the handheld cleaning apparatus 10 allows for water or other cleaners to more readily flow out of the cleaning apparatus 10 during use, which allows for easier and more efficient cleaning efforts.

Referring to an exemplary embodiment in FIG. 1, the handheld cleaning apparatus 10 is shown comprising a top surface 20, a bottom surface 21 (not shown, see FIG. 2), a front end surface 23 opposite a back end surface 24, a first side surface 25 opposite a second side surface 26, a plurality of latitudinal open channels 28 extending from the first side surface 25 to the to the second side surface 26, and a plurality of longitudinal open channels 29 (not shown, see FIG. 2) extending from the front end surface 23 to the back end surface 24.

In preferred embodiments, every surface 20, 21, 23, 24, 25, 26 of the handheld cleaning apparatus 10 comprises an abrasive coating. However, this is not to be considered limiting since alternative embodiments of the present invention where one or more surfaces do not have an abrasive coating are fully contemplated.

Figure 2:
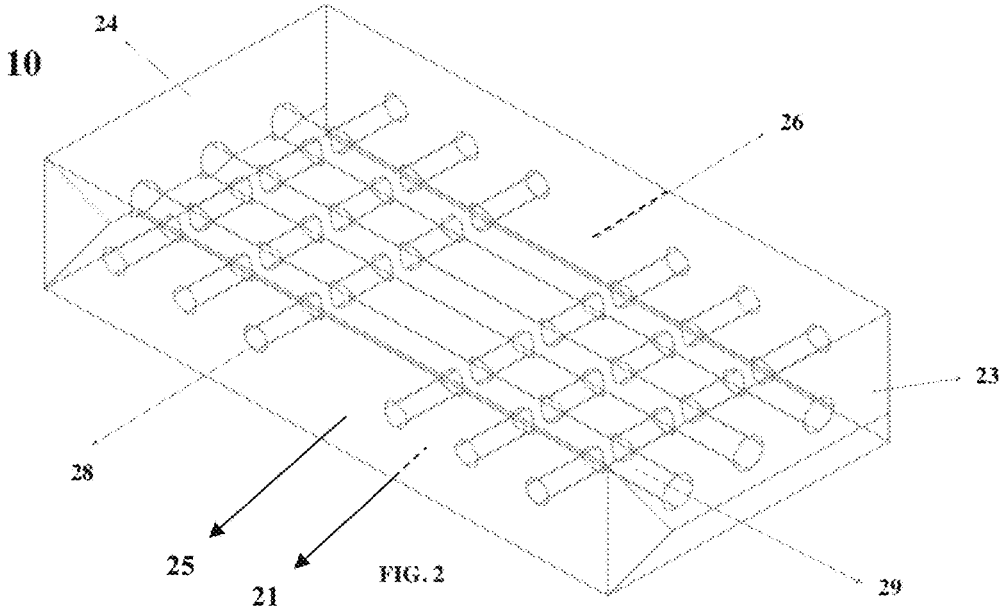
FIG. 2 illustrates a transparent perspective view of an exemplary embodiment of the handheld cleaning apparatus with longitudinal open channels and latitudinal open channels in accordance with the principles of the present invention.

As can be seen in FIG. 1, front end surface 23 is formed with a multi-faceted surface extending out from the apparatus 10 to provide a user with the ability to more easily clean into corners and other hard to reach areas such as tile grout lines. As can be seen in FIG. 2, back end surface 24 is also faceted in the same proportions as the front end surface 23 except that back end surface 24 extends into the apparatus 10. This allows two or more handheld cleaning apparatuses to be placed together such that the front end surface of a first cleaning apparatus 10 fits into the back end surface of a second cleaning apparatus 10. It is to be appreciated by someone skilled in the art that other embodiments of the present invention may not have faceted surfaces or may only have faceting on one surface. For example, an alternative embodiment of the present invention may have faceting on the front end surface 23 and a flat back end surface 24.

Moving now to FIG. 2, which is the exemplary embodiment of FIG. 1, shown is the handheld cleaning apparatus's 10 plurality of latitudinal open channels 28 extending from the first side surface 25 to the second side surface 26 and a plurality of longitudinal open channels 29 extending from the front end surface 23 to the back end surface 24 that promote water flow through the sponge and give the sponge enhanced flexibility to allow the cleaning surfaces to better conform to the surface being cleaned.

The handheld cleaning apparatus's 10 size and the number of the channels 28, 29 vary by the material or density of the sponge. (See FIGS. 3 and 4). For example, a handheld cleaning apparatus 10 made from a high density material may have larger channels 28, 29 since the higher density material will better allow the handheld cleaning apparatus 10 to more rigidly main its shape during use thereby applying uniform pressure to the surface being cleaned. Conversely, a handheld cleaning apparatus 10 made from a lower density material, such as a common household sponge, may have not only smaller but fewer channels to allow the softer sponge material to better maintain its shape during use.

Figure 3:
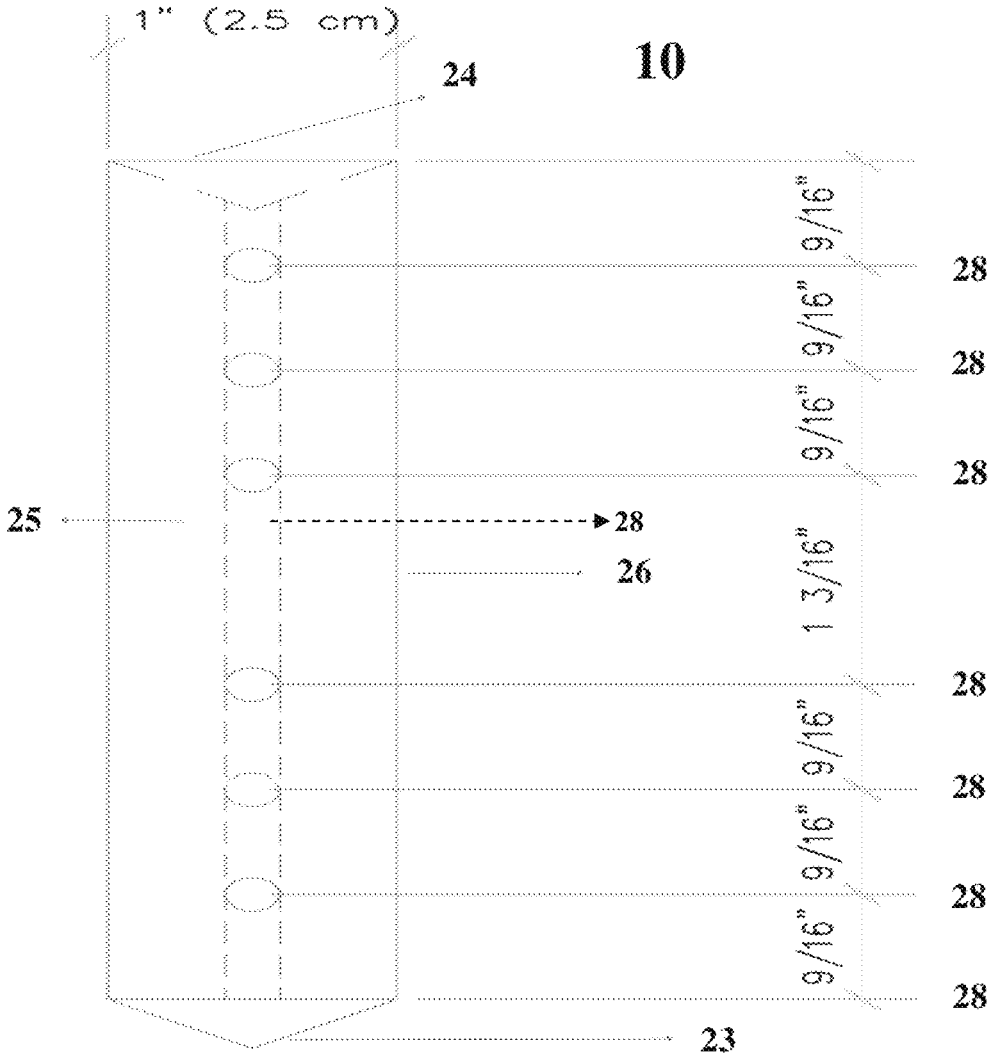
FIG. 3 illustrates a side view of an exemplary embodiment of the handheld cleaning apparatus with latitudinal open channels having exemplary spacing in accordance with the principles of the present invention.

Referring to FIG. 3, a side view of the handheld cleaning apparatus is shown. Latitudinal open channels 28 are shown equally spaced. The equal spacing allows for the handheld cleaning apparatus 10 to be inserted into an interconnecting mechanism 30 (not shown, see FIG. 6). It is to be appreciated by someone skilled in the art that the size and spacing of channels may vary and that the corresponding interconnecting mechanisms 30 can be varied to match the size and spacing of the latitudinal open channels 28. This also holds true for interconnecting mechanisms 30 sized and spaced to fit into the longitudinal open channels 29.

Figure 4:
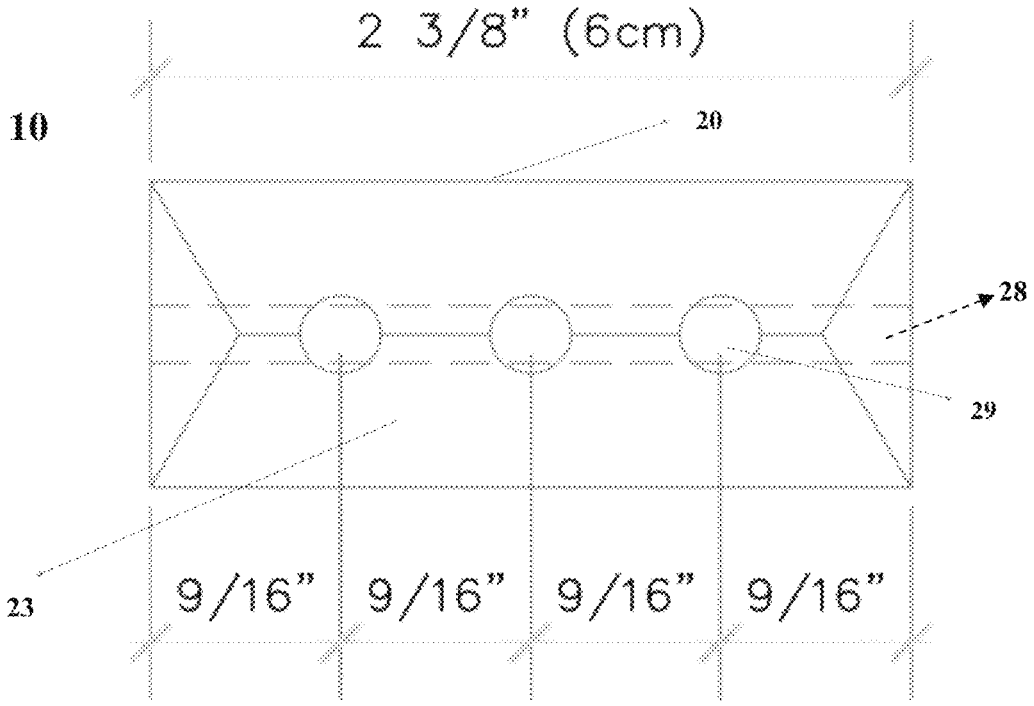
FIG. 4 illustrates an expanded front view of an exemplary embodiment of the handheld cleaning apparatus in accordance with the principles of the present invention.

FIG. 4 is a front view of the handheld cleaning apparatus 10. Shown is exemplary spacing of the longitudinal open channels 29 and the faceted design of the front end surface 23. The longitudinal open channels 29 may vary in size and spacing depending on factors such as density and size of the handheld cleaning apparatus 10.

Figure 5:
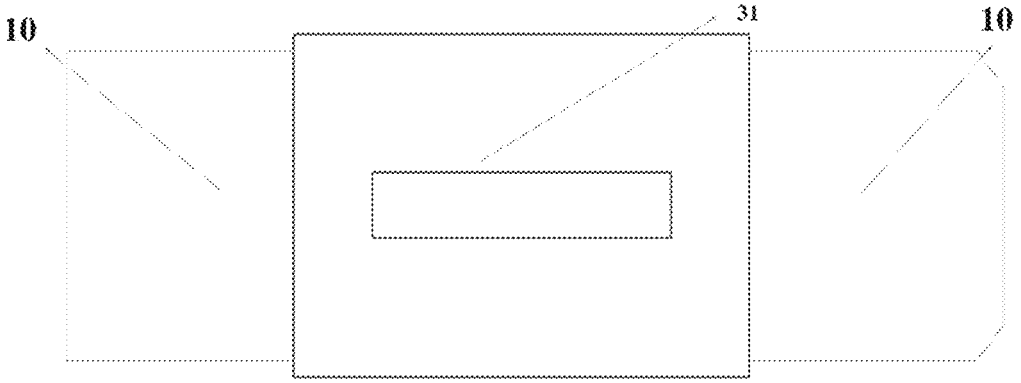
FIG. 5 illustrates a top view of two (2) exemplary embodiments of the present invention coupled together using a removable handle in accordance with the principles of the present invention.

FIG. 5 is a top view of two (2) handheld cleaning apparatus's 10 inserted into a removable handle 31. As discussed above, the spacing of the latitudinal open channels 28 (See FIG. 3) is consistent. This allows the interconnecting mechanisms 30 (Not shown, See FIG. 6) to capture the handheld cleaning apparatus 10 by securing the apparatus 10 into the removable handle 31 such that the interconnecting mechanisms 30 insert into the latitudinal open channels 28. This allows a user to grip the removable handle 31 instead of the cleaning apparatus 10 itself, thereby making it easier and more efficient to use.

Figure 6:
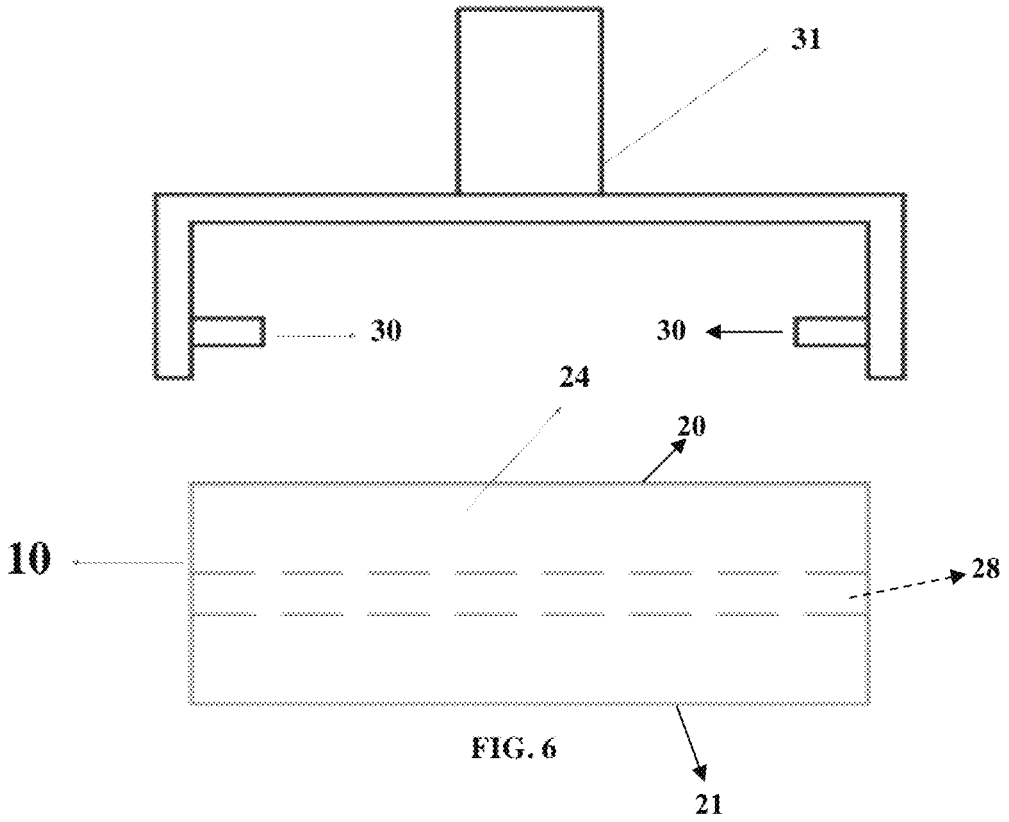
FIG. 6 illustrates an expanded back view of an exemplary embodiment of the handheld cleaning apparatus showing longitudinal open channels extending from the first side surface to the second side surface with a removable handle in accordance with the principles of the present invention.

Lastly, referring to FIG. 6, an end exploded view of the handheld cleaning apparatus 10 and the removable handle 31 with interconnecting mechanisms is shown. As shown, the interconnecting mechanisms 30 and the removable handle 31 are configured to match size and spacing of the latitudinal open channels 28 of the cleaning apparatus 10. In use, the handheld cleaning apparatus 10 is secured into the removable handle 31 when the interconnecting mechanisms 30 are inserted into the latitudinal open channels 28. It is to be appreciated by someone skilled in the art that a removable handle 31 with interconnecting mechanism 30 may be sized to accommodate a handheld cleaning apparatus 10 by inserting the interconnecting mechanisms 30 into the cleaning apparatus's 10 longitudinal open channels 29 (see FIGS. 2, 4). It is to be further appreciated by someone skilled in the art that a removable handle 31 may be sized to accommodate multiple handheld cleaning apparatuses. It is to also be appreciated that the width, length, and thickness of the handheld cleaning apparatus 10 may be varied to accomplish specific cleaning tasks. The interconnecting mechanism 30 may by screws, bolts, rubber, bamboo, wood, or clips as a means of securing one or more of the cleaning apparatuses 10 into a removable handle 31.

All of the embodiments described herein are exemplary embodiments provided to enable persons skilled in the art to make or use the disclosure and not to limit the scope of the disclosure that is defined by the claims.

What is claimed is:

1. A cleaning device comprising:

a generally block-shaped sponge body comprising a water-permeable sponge material having a plurality of sides, the plurality of sides including:

a first pair of opposing sides that are substantially planar and parallel to each other;

a second pair of opposing sides that are substantially planar and parallel to each other and that extend between and are transverse to the first pair of sides; and opposing end portions disposed at ends of the sponge body;

a first set of latitudinal channels formed in the sponge body that intersect and fully extend between each of the first pair of opposing sides without also intersecting any other sides of the sponge body;

a second set of longitudinal channels formed in the sponge body that intersect and extend from one of the end portions toward the opposing end portion without also intersecting any other sides of the sponge body, the second set of channels intersecting and coupling to the first set of channels to allow fluid flow between the first and second set of channels; and an abrasive outer shell that coats at least one of the sides of the sponge body.

2. The cleaning device of claim 1, where the abrasive outer shell coats at least four sides of the sponge body.

3. The cleaning device of claim 1, where the abrasive outer shell coats all sides of the sponge body.

4. The cleaning device of claim 1, wherein one of the end portions comprises an outwardly extending faceted surface.

5. The cleaning device of claim 4, wherein the other end portion comprises an inwardly extending faceted surface.

6. The cleaning device of claim 5, wherein the inwardly and outwardly faceted surfaces are complementary to each other such that the inwardly faceted surface is adapted to receive the outwardly extending faceted surface of another such sponge body.

* * * * *